United States Patent [19]

Shea

[11] 4,237,855

[45] Dec. 9, 1980

[54] FLUE THROTTLE

[76] Inventor: Melvin E. Shea, 85 Terrace Rd., Milford, Conn. 06460

[21] Appl. No.: 54,561

[22] Filed: Jul. 2, 1979

[51] Int. Cl.[3] ..... F23L 13/00

[52] U.S. Cl. ..... 126/285 B; 431/20; 236/1 G

[58] Field of Search ..... 236/1 G; 431/20; 126/292, 285 B, 286

[56] References Cited

U.S. PATENT DOCUMENTS 4,108,369 8/1978 Prikkel ..... 236/1 G

*Primary Examiner*—Carroll B. Dority, Jr.

[57] ABSTRACT

A flue throttle to control the amount of flue gas or heated air going out the flue from a heating system, by throttling the flue to the minimum amount required while the heat source is on and to change to a further reduced or a complete throttling of the flue when the burner or heat source is off. The heat source referred to throughout this application is from the combustion of fuel through an electric motor driven burner.

1 Claim, 9 Drawing Figures

FIG 1
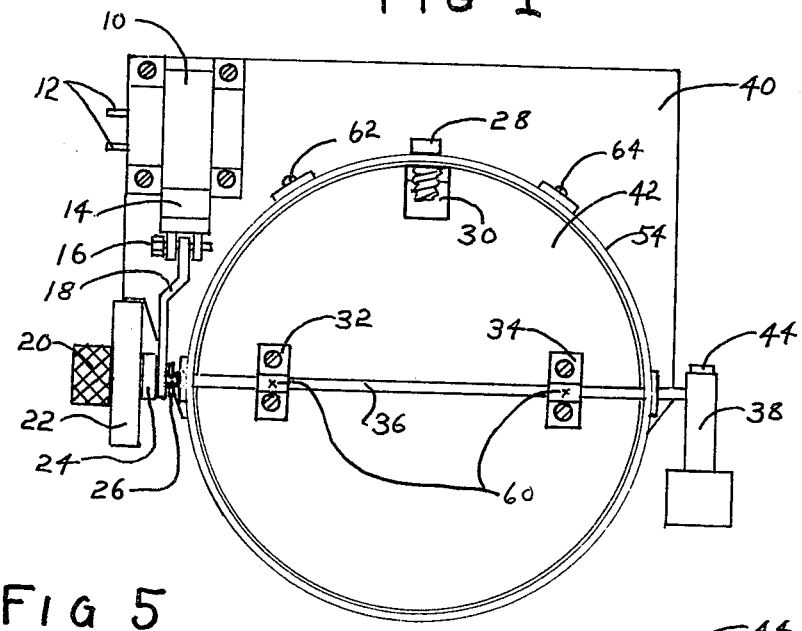
FIG 2
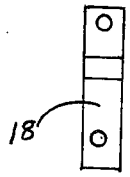
FIG 3
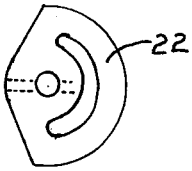
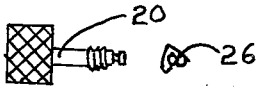
FIG 4
FIG 5
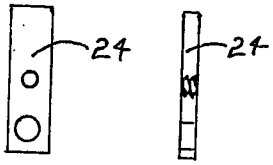
FIG 6
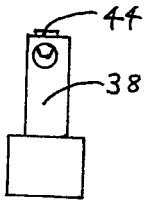
FIG 7
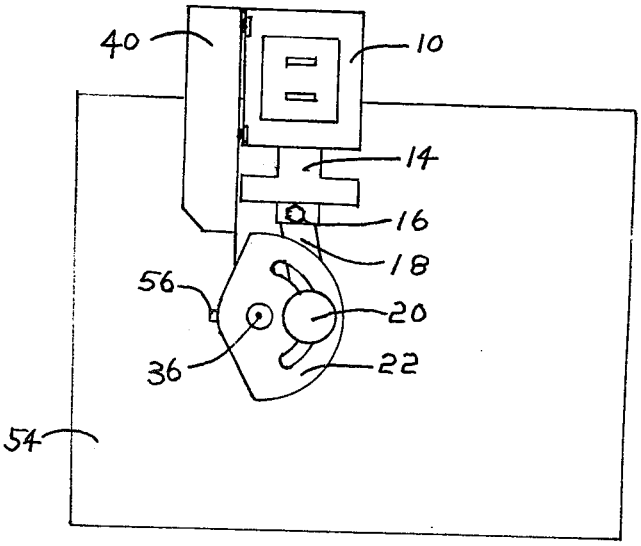
FIG 8
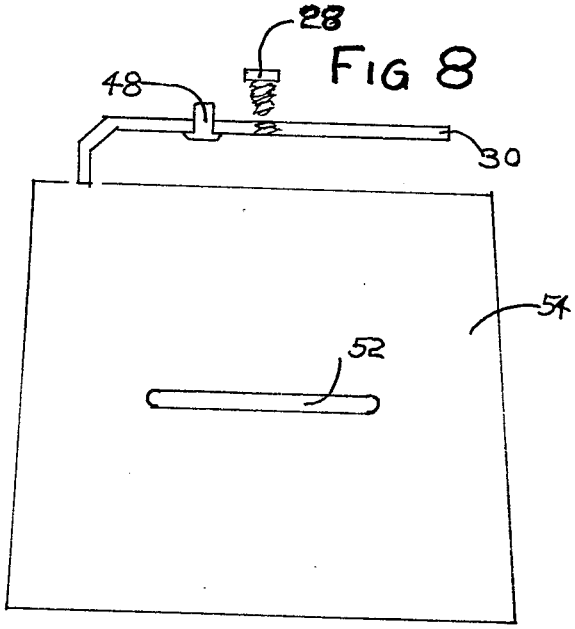
FIG 9

FLUE THROTTLE

For conservation of energy, it is desirable to save as much of the heat escaping through the flue as possible. As much as 90% of the fuel we burn for energy for heating or for power can be wasted by going up the flue. All well designed and engineered chimneys and flues are made oversized. To conserve fuel I recommend throttling the heated gases and heated waste air passing through these. Part of this waste occurs while the heat source is on because the heat is leaving the heat exchanger via the flue quicker than it should. Part of the waste occurs while the heat source is turned off, as between the on and off cycles of the heat source during normal operation of the system. Each time the heat source cycles to off, much of the heat that remains in the heat exchanger will continue to flow unrestricted through the flue and be wasted. When the heat source recycles to on, it has to replace the energy that went out the flue before it gets the heat exchanger back to the temperature it was before it recycled to the previous off cycle. By throttling the flue to a bare minimum during the time the heat source is on we slow down the heat leaving the heat exchanger during this period thereby allowing the heat exchanger (boiler or furnace) to absorb more heat than would be otherwise possible, and by further throttling of the flue to a bare minimum if a pilot remains lit, or to a complete shut off of the flue during the off cycle of the heating source we conserve further. This invention will accomplish the throttling of the flue as recommended above.

IN THE DRAWING

FIG. 1 is a front view of the Flue Throttle Device.

FIG. 2 is a side view of Linkage

FIG. 3 is front view of Adjusting Plate

FIG. 4 is side view of Adjusting Knob Pin and shows top view of Metal Fastener for same.

FIG. 5 is front and side view of Lock Plate

FIG. 6 is end view of Weighted Handle

FIG. 7 is side view of Flue Throttle Device

FIG. 8 is side view of Adjustable Bumper

FIG. 9 is top view of Slotted Opening

The Mounting Bracket 40 as is shown in the drawing is made of sheet metal the thickness of 0.07" to 0.15" and is formed to straddle the Flue Pipe 54 and is secured to the Flue Pipe 54 by Rivets 62 and 64 through flanges formed in Mounting Bracket 40 and is held in position by Shaft 36 which passes through holes drilled through Flue Pipe 54 and flanges formed in Mounting Bracket 40. Shaft 36 is of metal rod of a diameter to support the Flue Throttle 42. Flue Throttle 42 is a solid disc formed from metal plate of a thickness of 0.125" to 0.1875". Shaft 36 is fastened to Flue Throttle 42 by Metal Straps 32 and 34 which are secured to Flue Throttle 42 by Threaded metal screws. Metal Straps 32 and 34 are secured to Shaft 36 by Spot Welding 60. Weighted Handle 38 is formed from a block of metal and is 0.5" wide at the top end and 1.0" wide at the bottom heavy end, and is increased in width from the 0.5" to 1" at a point 1" from bottom of handle, and is 3" long and is attached to Shaft 36 through hole drilled in lighter end of Weighted Handle 38 and is locked in place on Shaft 36 at opposite end from Plate 22 and at right angle to Flue Throttle 42 in a position whereby the weight of Weighted Handle 38 will tend to close Flue Throttle 42. Weighted Handle 38 is locked in this position by Set Screw 44. Adjusting Plate 22 is made from metal plate of a thickness of 0.30" to 0.50" and is arch shaped with a drilled hole to fit the Adjusting Plate 22 to the Shaft 36, and an arced adjustment slot located ⅔ of the way between the drilled hole and the arced edge of the Adjusting Plate 22. The width of the arced slot is sized to closely accomodate Adjusting Knob Pin 20. Adjusting Plate 22 is fastened to Shaft 36 by Pressed Pin 56. The position of the Adjusting Knob Pin 20 in the arced slot of Adjusting Plate 22 governs the distance that the Solenoid Draw Bar 14 can travel. This in turn governs the amount the Adjusting Plate 22 can rotate. The Adjusting Plate 22 is pinned to Shaft 36 and permanently fixed in a position, whereby when the Adjusting Knob Pin 20 is locked into the Adjusting Plate 22 at a position that is equi-distant from each end of the Slotted Arc in Adjusting Plate 22 with Solenoid 10 energized, the Flue Throttle 42 will be at a position half way opening the flue passage. The Adjusting Knob Pin 20 governs the amount Shaft 36 can rotate. Shaft 36 is fixed to Flue Throttle 42. The setting of the Adjusting Knob Pin 20 in the Adjusting Plate 22 governs the amount Flue Throttle 42 opens or closes. Adjusting Knob Pin 20 is made of a metal block and is formed in one piece with a pin section on one end, a threaded shaft section in the middle and a knob section on the outer end. The Adjusting Knob Pin 20 passes through the slotted arc of Adjusting Plate 22, then through the threaded section of Lock Plate 24 then through the bottom hole in the Linkage 18 where it is secured by Metal Fastener 26. The Adjusting Knob Pin 20 is locked into position in Adjusting Plate 22 by tightening Adjusting Knob Pin 20 firmly into threaded section of Lock Plate 24. Linkage 18 is of metal plate of a thickness of 0.125" to 0.1875" and width of 0.50" and a length to join the Solenoid 10 to the Adjusting Knob Pin 20 and has a hole 0.125" diameter drilled 0.20" from each end and equi-distant from the sides. The bottom drilled hole of Linkage 18 is fitted to Adjusting Knob Pin 20 and secured by Metal Fastener 26. The upper hole is fitted to Solenoid 10 by threaded Member 16 to Solenoid Draw Bar 14. Solenoid 10 is fastened to the upper left hand corner of Mounting Bracket 40 by Sheet metal screws or other suitable threaded members and is sized with a Draw Bar 14 with enough travel and lifting power to move Adjusting Plate 22 and Flue Throttle 42 from completely closed to completely open position. Lock Plate 24 is of metal plate of thickness of 0.25" and width of 0.75" and is drilled with a hole to slide freely over shaft 36 at one end and provided with a drilled and tapped hole threaded to accomodate threaded portion of Adjusting Knob Pin 20. Said threaded hole is aligned with slot in Adjusting Plate 22, whereby Lock Plate 24 can function as the locking device for Adjusting Knob Pin 20 and Adjusting Plate 22. Bumpers 30 is of metal of a thickness of 0.125", a width of 0.50" and a length 1.5 times as long as Slot 52 and is formed with the bumper end bent 90° from the sliding portion and to a depth of 0.75". Said bent end portion to act as a stopper for Flue Throttle 42. The longer flat portion of Bumper 30 acts as a slide for the adjustment for the amount of closure for the Flue Throttle 42 and is slid to desired position in Slot 52 and held in alignment with Slot 52 by Metal Rivet 48 and Lock Screw 28 and is locked into set position by Lock Screw 28. Bumper 30 can be set to allow total closure of Flue Throttle 42 or to leave Flue Throttle 42 partially open to allow for venting of a pilot light. Slot 52 is an elongated opening in Flue Pipe 54 and is positioned and formed to accomodate Bumper 30.

The heating source is wired in parallel with Solenoid 10, at terminals 12. When the heating source comes on, Solenoid 10 is energized lifting Solenoic Draw Bar 14 which lifts linkage 18, lifting Adjusting Knob Pin 20, rotating Adjusting Plate 22, rotating Shaft 36 and opening Flue Throttle 42.

With Solenoid 10 activated and Flue Throttle 42 now in open position, and the heat source operating, to adjust Flue Throttle 42, hold Weighted Handle 38, loosen Adjusting Knob Pin 20, rotate and adjust Weighted Handle 38 to cut off the flue passage to the point at which it causes the heating source to smoke, then raise Weighted Handle 38 slowly, opening Flue Throttle 42 slowly until the smoke just clears, at this point relock Adjusting Knob Pin 20 in Lock Plate 24 and against Adjusting Plate 22. The flue is now throttled to the minimum amount necessary with heat source on.

When the heat source shuts down, Solenoic 10 will de-activate. The weight of Solenoid Draw Bar 14 and Weighted Handle 38 will cause Shaft 36 to rotate closing Flue Throttle 42 towards Bumper 30, while Adjusting Plate 22 and Adjusting Knob Pin 20 rotate, lowering Linkage 18 and Solenoid Draw Bar 14 only by the amount necessary to allow Flue Throttle 42 to come to rest against Bumper 30.

I claim:

1. A device for controlling gases through a flue pipe comprising: a flue pipe, a disc inside the flue pipe and corresponding to the inside cross-section of the flue pipe, a shaft extending through the flue pipe and attached to said disc for pivotally mounting the disc, a solenoid, means attaching said solendoid to said flue pipe, lever means connecting said solenoid to said shaft for rotational movement of said shaft, adjustment means for said lever means, said flue pipe including an elongated slot, a bumper means having a portion extending through the slot in said flue pipe to engage said disc, means for adjusting the position of said bumper means along said flue slot to control the amount of closing of said flue pipe by said disc in said flue pipe, the amount of opening of said flue pipe by said disc being controlled by said lever adjustment means.

* * * * *